US008800438B2

(12) United States Patent
Beck

(10) Patent No.: US 8,800,438 B2
(45) Date of Patent: Aug. 12, 2014

(54) APPARATUS FOR LABELING CONTAINERS, PARTICULARLY SPECIMEN CONTAINERS FOR MEDICAL SPECIMEN, METHOD FOR LABELING CONTAINERS, AND USE OF A LABELING APPARATUS

(75) Inventor: Paul Beck, Ulm (DE)

(73) Assignee: Pernutec GmbH, Lauphein (DE)

( * ) Notice: Subject to any disclaimer, the term of this patent is extended or adjusted under 35 U.S.C. 154(b) by 143 days.

(21) Appl. No.: 13/382,238

(22) PCT Filed: Jul. 13, 2010

(86) PCT No.: PCT/EP2010/004246

§ 371 (c)(1),
(2), (4) Date: Jan. 4, 2012

(87) PCT Pub. No.: WO2011/006633

PCT Pub. Date: Jan. 20, 2011

(65) Prior Publication Data

US 2012/0097055 A1 Apr. 26, 2012

(30) Foreign Application Priority Data

Jul. 15, 2009 (DE) ..... 10 2009 033 513

(51) Int. Cl.
*B41F 17/08* (2006.01)
*B41J 3/407* (2006.01)

(52) U.S. Cl.
CPC ..... *B41J 3/4073* (2013.01)
USPC ..... 101/35; 101/42; 101/43; 101/44; 101/36; 101/37; 101/38; 101/39; 101/40.1; 400/211; 400/212; 400/213.1; 400/217

(58) Field of Classification Search
CPC ..... B41J 3/407; B41J 3/4073; B41F 17/14–17/34; G01N 2035/00801; G01N 2035/00861
USPC ..... 101/35, 42, 43, 44, 36–40.1; 400/211, 400/212, 213.1, 217
See application file for complete search history.

(56) References Cited

U.S. PATENT DOCUMENTS 4,676,680 A * 6/1987 Hauger et al. ..... 400/211
4,901,095 A 2/1990 Perra et al.

(Continued)

FOREIGN PATENT DOCUMENTS

DE G 82 00 185.5 5/1982
DE 102 35 611 A1 2/2004

(Continued)

OTHER PUBLICATIONS

PCT Translation of International Preliminary Report of Patentability for PCT/EP2010/004246, Mailed Mar. 8, 2012.

(Continued)

*Primary Examiner* — Daniel J Colilla
*Assistant Examiner* — Quang X Nguyen
(74) *Attorney, Agent, or Firm* — Opticus IP Law PLLC

(57) ABSTRACT

The invention relates to an apparatus for labeling containers, especially specimen containers for medical specimens. The apparatus comprises a printing device; a supply and removal device for supplying and removing at least one container to and from the printing device. The printing device is designed such that it can be moved into at least one first position and into a second position. In the first position, the container is automatically supplied to and removed from the printing device with the aid of the supply and removal device. The container can be manually supplied and removed from the printing device when it is in the second position.

3 Claims, 3 Drawing Sheets

(56) References Cited

U.S. PATENT DOCUMENTS

| | | | | |
|---|---|---|---|---|
| 5,356,595 | A * | 10/1994 | Kanamori et al. | 422/65 |
| 6,350,071 | B1 * | 2/2002 | Conwell et al. | 400/118.2 |
| 6,499,842 | B1 | 12/2002 | Kofman et al. | |
| 6,572,824 | B1 | 6/2003 | Ostgaard et al. | |
| 6,951,663 | B1 | 10/2005 | Edwards | |
| 2002/0097280 | A1 | 7/2002 | Loper et al. | |
| 2009/0160923 | A1 * | 6/2009 | Custer | 347/102 |

FOREIGN PATENT DOCUMENTS

| | | | |
|---|---|---|---|
| EP | 1391310 | A2 | 2/2004 |
| WO | WO 2007 135388 | A1 | 11/2007 |

OTHER PUBLICATIONS

Fisher Scientific Print Mate Informational Sheet.

* cited by examiner

APPARATUS FOR LABELING CONTAINERS, PARTICULARLY SPECIMEN CONTAINERS FOR MEDICAL SPECIMEN, METHOD FOR LABELING CONTAINERS, AND USE OF A LABELING APPARATUS

This Application claims priority from German Patent Application Serial No. 10 2009 033 513.7, filed on Jul. 15, 2009, and from PCT Patent Application No PCT/EP2010/004246 filed on Jul. 13, 2010, which Applications are incorporated by reference herein.

FIELD OF THE INVENTION

The invention relates to an apparatus for labeling containers, in particular specimen containers for medical specimens, comprising a printing device and a device for supplying and/or removing at least one container to/from the printing device. Furthermore, the invention relates to a method for labeling containers, and the use of an apparatus for labeling containers.

BACKGROUND ART

In laboratories in which medical samples are processed, especially tissues samples, for example in pathology, the individual samples are placed in containers for the specific patient for further processing. The samples such as tissue samples placed in the containers are provided with print, such as the printed date or printed IDs such as a barcode for automated processing, especially for identification. The samples are supplied to a labeling apparatus for this purpose.

One such apparatus for labeling containers for tissue samples is for example the "Thermo Scientific Shandon PrintMate™ system by Thermo Fisher Scientific Inc. Reference is made to the documents published by Thermo Fisher Scientific Inc. at the time of the priority application.

Prior art systems have several disadvantages. One disadvantage in particular is that they were only designed for processing batches, that is, to process a plurality of containers. Another disadvantage is that very expensive printing systems are used.

DE 102 35 611 A1 discloses an apparatus for labeling laboratory articles made of glass using a printer where an inkjet printing method or thermal transfer method is used as the printing technique. In order to print different locations on the laboratory articles, especially flat glass slides, the printing head can be mounted so that it is movable or pivotable. A disadvantage of the apparatus in DE 102 35,611 A1 is that the printing of plastic substrates, especially with beveled edges, is impossible, as is manual supplying.

U.S. Pat. No. 6,951,633 B1 also discloses an apparatus for labeling microscopic slides or cassettes for histological samples using an ink jet printhead, and this system enables manual supply in that a cassette is manually inserted into the system for which the entire operatic automatic operation needs to be interrupted for more than one minute.

DE 8200185 U1 discloses a printer with a printing mechanism that can be manually or automatically supplied with a stack by means of driven tractors. DE 82 00 185 U1 relates to the supply of containers or three dimensional bodies as well as the supply of thin paper.

WO 2007/135 388 A1 discloses an apparatus for labeling plastic cassettes using a thermal transfer method.

U.S. Pat. No. 6,572,824 B1 discloses a system for labeling containers where the supply is exclusively automated.

EP 1 391 310 A2 discloses an apparatus for applying a three-dimensional colored image onto a paper substrate.

U.S. Pat. No. 4,901,095 B1 discloses an apparatus for labeling with a moveable printhead.

US 2002/0097280 A1 discloses an apparatus and a method for applying images to sports articles.

U.S. Pat. No. 6,499,842 B1 discloses an apparatus for applying an image to an item of food.

BRIEF DESCRIPTION OF THE DRAWINGS

The invention is described below with reference to the following Figures.

DETAILED DESCRIPTION OF THE INVENTION

Figure 1:
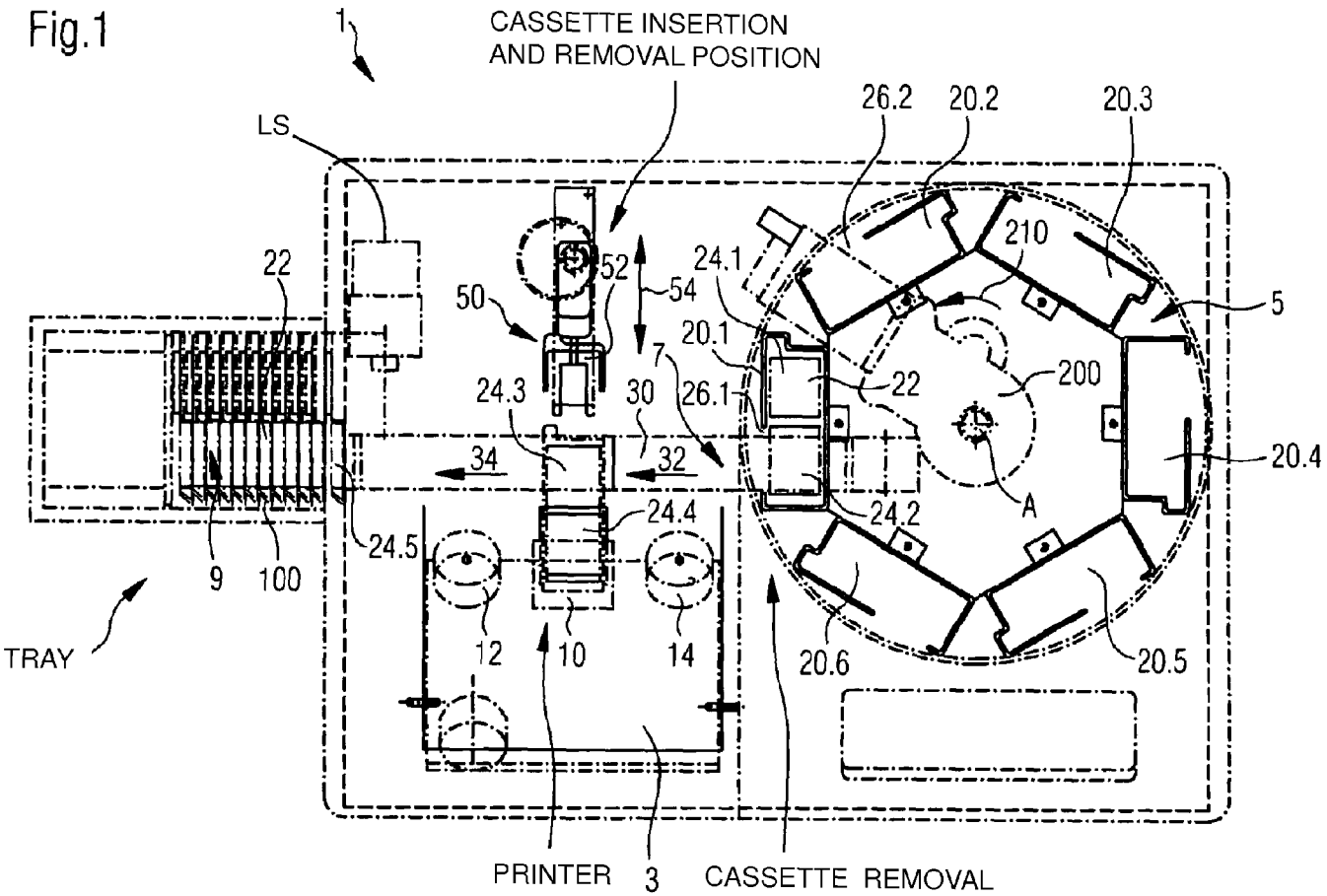
FIG. 1 is a top-down ("bird's eye") view of an apparatus according to the invention.

The problem of the invention is therefore to avoid the problems of the prior art, and in particular to disclose a system that permits the processing of batches and also allows individual containers to be corrected and labeled outside of batches. This is achieved according to the invention in that the printing device in the apparatus for labeling the individual sample containers is designed so that it can be brought into at least two positions. In the apparatus according to the invention, the container is supplied to and or removed from the printing device automatically using supply and removal devices when the printing device is in a first position. If the printing device is moved into the second position, automatic supply ceases, and individual containers can be manually supplied to the printing device and individually printed.

According to the invention, the printing device is moved into the first and second position by designing the printing device, and in particular the entire printing device with printhead and ink ribbon, to be pivotable about an axis. In a first position, the printing device can be aligned so that the container to be printed is supplied in a plane such as a plate plane. If the side of the container to be labeled has a bevel, the printing device with the printhead is folded up or pivoted away at the same angle as the bevel since the labeling surface and the print surface of the printhead lie in substantially the same plane. In a second position, the printhead of the printing device is arranged so that the container can be supplied manually from above. In one embodiment, the second position is selected so that the printing device lies in a plane that is parallel with the plate plane.

By pivoting the printhead, especially the entire printing device for automated and manual operation, the area that is used for automatic operation is spatially separated from the area that is used for manual operation. This allows a cassette to be manually labeled by briefly stopping automatic operation by less than 20 seconds, preferably less than 10 seconds, and especially less than 5 seconds. In particular, by spatially separating the automatic and manual area when manually labeling a cassette, the process of automatic operation is only slightly impaired. Automatic operation is briefly stopped while the printhead or printing device is moved into the position for manual operation and labeling occurs.

In addition to the pivoting device for pivoting the entire printhead, other possibilities are of course conceivable for moving the printhead into different positions such as moving it vertically. However, pivoting about an axis is distinguished by a simple design.

To prevent for example a feed unit from being automatically supplied when the print head is pivoted into the position for manual operation, it is advantageous to provide a detection unit for detecting the respective position of printhead, for example the first position of the printhead. The detection unit can be designed so that the printhead is turned off once it is pivoted out of the position in which automatic supply occurs. Only manual supply is then possible. Such a detection unit is for example a magnetic switch that is closed when the printing device or printhead is in the position for automatic operation. If the printing device is moved out of the position for automatic operation into a different position, the switch is open and automatic operation is interrupted.

It is particularly advantageous when the printing device comprises a needle printing device with at least one needle printhead. It is particularly advantageous to use a needle printing device since such a printing device is distinguished by a high degree of reliability and a robust design. In particular, the print is more durable in contrast to the prior-art jet printing method or laser print method. For example, when a needle printer is used for application, there is greater resistance to solvents, especially organic solvents, and the applied label is more resilient to abrasion.

In particular when a needle printer is used, the dye of the dye ribbon can be selected to ensure resistance to acetone. This is for example possible with a dye that, after it is applied onto the cassette, is irradiated with UV light and thereby polymerized in a device downstream from the printing device. Acetone resistance, that is, resistance to the solvent acetone is ensured by the polymerization. The dye in the printing device is preferably also resistant to alcohols, xylene, paraffin and formaldehyde. In contrast to ink, a dye contains dye pigments. It is particularly preferable when the device downstream from the printing device for irradiating the printed label with the UV light to be an LED light source is not a UV lamp light source. The advantage of using one or a plurality light-emitting diodes as a light source is that the design of the device is much simpler than a device with a UV lamp. In particular, the design can be miniaturized when LEDs are used.

Furthermore, since the life is longer, they do not have to be frequently exchanged which significantly increases the service life of the device in comparison to prior art devices.

It is particularly preferable when the supply and/or removal device comprises a pushing and gripping device by means of which the container can, for example, be removed from a conveyor belt and brought into the printing position for the printing device. The gripping device is for removing the container from the printing device after being printed and for example being positioned on a conveyor belt.

To process entire batches, it is advantageous when the apparatus has a supply receptacle and receiving receptacle. The individual containers from the supply receptacle are for example supplied to a transport device that preferably can comprise a conveyor belt by means of the pushing and gripping device. The pushing and gripping device then transfers them into the printing device. It is particularly preferable when the transport device is a circulating conveyor belt, particularly one or a plurality roller chains.

In addition to the automated supply and removal device, a guide support is advantageously provided that supports manual insertion into the printing device when it is for example moved into the second position.

A particularly high throughput can be achieved when the supply receptacle is designed as a rotary magazine, and the rotary magazine has a plurality of cassettes for receiving the containers. The individual cassettes can be removed from the carousel and individually filled. The carousel itself rotates and always provides a connection between the magazine and conveyor belt. The containers placed in this magazine are then supplied by means of the transport device and pushing and gripping device to the printing device.

When exchangeable cassettes and a rotary magazine are used, the individual cassettes can be filled outside of the apparatus and then inserted in the carousel. Filling therefore does not have to take place in the apparatus.

In order for the printing process to be automated when the printing device is moved into the first position, the apparatus advantageously comprises a control and regulating device that controls the printing device, the supply and removal device, the supply receptacle and the receiving receptacle. It is particularly preferable when the control/regulation device controls the motors for the printing device in the supply and removal device of the supply receptacle and the receiving receptacle depending on control and regulation signals.

The control and regulation device as well as the electric motors are preferably powered in the apparatus according to the invention with low voltage, for example with 24 V. This makes it possible to place a transformer for converting voltage from for example 220 V to 24 V outside of the apparatus. Locating the voltage converter or transformer outside the apparatus advantageously increases operating reliability since the transformer only has to be exchanged by unplugging and plugging when for example the power supply fails; in addition, the apparatus does not comprise any power modules that release a great deal of heat and have to be supplied with mains voltage.

To provide the required power e.g. for the electric motors of the supply and removal device as well as for the electric motors of the printing device, is preferable to avoid voltage peaks when supplying a low voltage of 24 V by for example using high-performance capacitors in the control and regulation device that provide the necessary amount of power when necessary.

In addition to the apparatus, the invention provides a method for labeling containers. In the method according to the invention, and for example first a sensor is used to detect whether the printing device is in the first position for automatic operation. The detector then sends the corresponding signal to the control and regulation device. The control and regulation device then controls the supply device from which a container is removed, and the container is moved by means of the transport device to the position of the pushing and gripping device. Once the transport device reaches the position of the pushing and gripping device, the transport device stops, and the pushing and gripping device transports the container into the printing position in the printing device. In the printing position in the printing device, the print is then applied to the container, for example using the needle printer. Once the lettering is applied, it is sensed, and a gripping device transports the container back to the transport device. When it is detected that the container is lying on the transport device, the transport device is restarted, and the labeled container is conveyed into the repository.

If is contrastingly detected that the printing device has been moved out of the first position, automatic supply does not occur; instead, the control and regulating device turns off the automatic supply and printing of the containers. A container manually inserted into the printing device can then be individually printed.

The apparatus according to the invention and the method according to the invention are preferably used to label containers that mark medical samples, especially tissue samples. The preferred use of the apparatus according to the invention is hence clinical chemistry and in particular pathology.

The invention will be further described below with reference to the Figures and exemplary embodiments without being restricted thereto.

A bird's-eye view of an apparatus according to the invention is shown in FIG. 1. The apparatus according to the invention 1 comprises the printing device 3 and supply device 5, the transport device 7 and the repository 9.

The printing device 3 is a needle printer having a needle printhead 10 with a printing side 11, and two rollers 12, 14 that hold a dye ribbon that is guided past a needle printhead 10. The dye ribbon is preferably provided with a dye that is polymerized by means of light from a light source LS, particularly UV light, after the text is applied onto the container to be printed. The lettering thereby possesses a resistance especially against organic solvents, especially acetone.

The supply device 5 is designed as a rotary magazine having a total of six magazines that are preferably designed as exchangeable magazines 20.1, 20.2, 20.3, 20.4, 20.5, 20.6.

The container 22 to be printed is drawn in magazine 20.1. The container 22 is moved out of position 24.1 in magazine 20.1 into position 24.2. In position 24.2, the container that for example holds a tissue sample is arranged opposite a discharge opening 26 of the magazine. The container 22 in position 24.2 is received by the conveyor belt 30 of the transport device 7 and transported in the direction of the arrow 32 to position 24.3. Transporting can be coupled to or decoupled from the supply of a container from the supply device. When supply is decoupled, the container is transported independent of whether or not a new container has been deposited. This enables, for example, supply from different magazines of the rotary magazine. It is therefore possible for example to provide the containers in the different magazines with different printing. Once the container 22 reaches position 24.3, the conveyor belt 30 is stopped and a signal is sent to the pushing and gripping device 50. With the assistance of the pushing and gripping device 50, the container is moved in direction 54 into position 24.4 by means of the pusher or gripper 52. Position 24.4 corresponds to the printing position in the printing device 10. Once the container reaches the printing position 24.4, the container that holds the tissue sample is provided with a corresponding code or mark by means of the needle printer 3. After printing is finished, the gripper 52 of the gripping device moves the container from position 24.4 into position 24.3 on the conveyor belt, especially the roller chain. The placement on the conveyor belt in position 24.3 after printing is detected and sent to the control device 20 (not shown) which then causes the conveyor belt to start moving. The container on the conveyor belt 30 is moved in direction 34 into position 24.5 in the repository.

Each container is deposited in the depository shown in this embodiment. The beveled and printed side 100 of the individual containers 22 can be distinctly seen. The bevel of the container 22 on the printed side is between 40 and 50°, and preferably 43°. It is particularly preferable to make the applied labeling insoluble especially to acetone by polymerizing the label through the supply of energy, particularly UV light.

Of course, it would also be possible to design the repository differently, for example with standing magazines, especially in the form of a rotary magazine like the supply device. A rotary magazine design would allow ordered deposition, such as deposition corresponding to the supply for example from the supply rotary magazine.

In a first embodiment of the invention, when the cassette 20.1 shown in FIG. 1 is completely empty and all of the containers contained therein have been labeled, the rotary magazine can be rotated by means of a motor 200 in direction 10 about axis A until the discharge opening 26.2 of the exchangeable magazine 20.2 comes to rest so that the containers stored in the magazine 20.2 can be deposited on the conveyor belt 7. If the transport device is separate from the supply device, containers can be supplied from different cassettes, and complete emptying before the containers can be supplied from other magazines is unnecessary.

Figure 2:
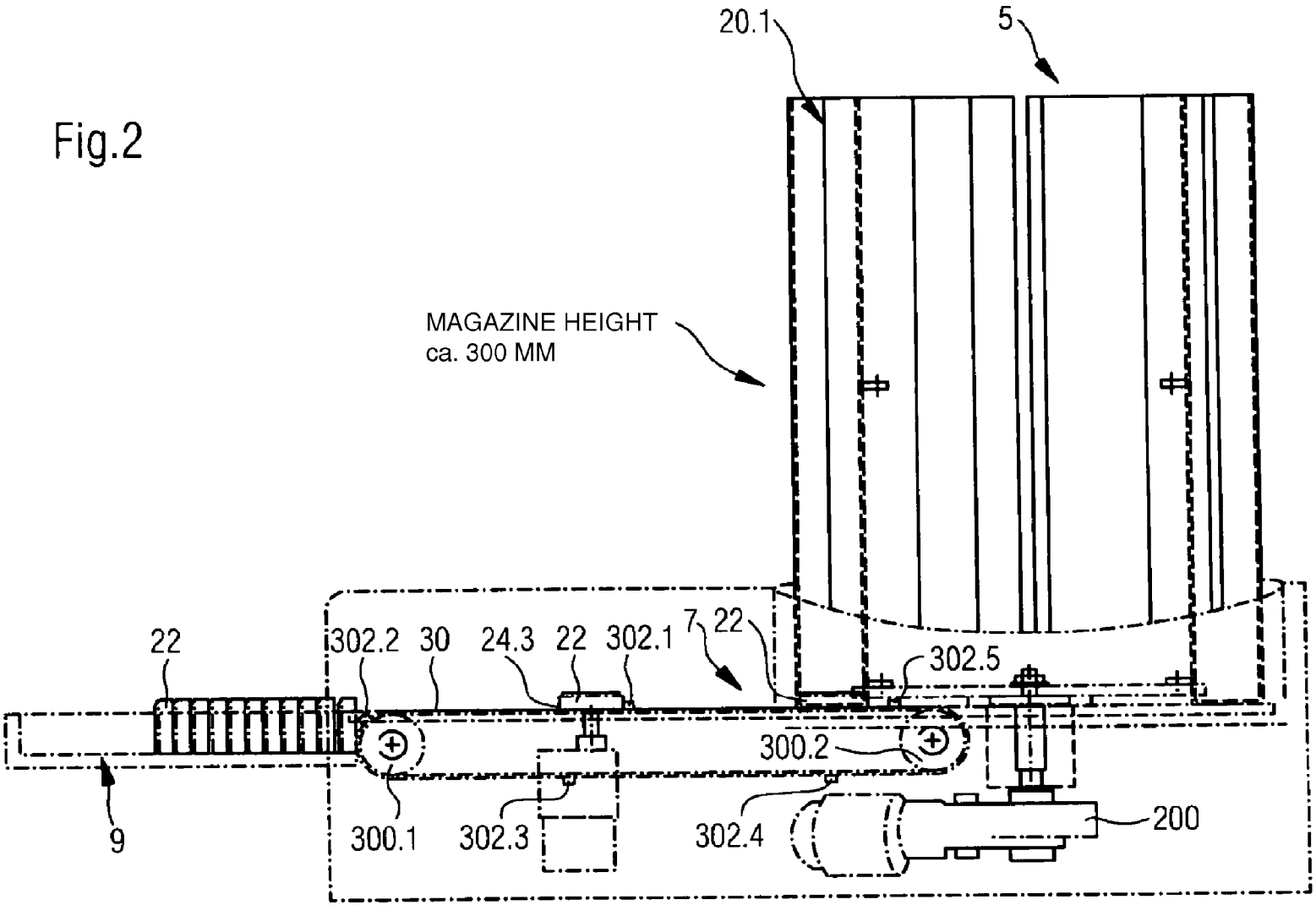
FIG. 2 is a side view of the apparatus according to the invention.

The design of the transport device as a conveyor belt and the drive of the rotary magazine can be visualized particularly well in the side view in FIG. 2.

As shown in FIG. 2, the transport device 7 is a circulating conveyor belt 30, in particular one or a plurality roller chains that are deflected by two rollers 300.1, 300.2. The conveyor belt or roller chain has transport elevations 302.1, 302.2, 302.3, 302.4, 302.5, in particular catches. With the assistance of the transport elevations, the container 22 can be moved from the magazine 24.1 of the supply device 5 into position 24.3 from where the magazine 22 can be transferred into the printing device by means of the pushing and gripping device.

The motor for driving the rotary magazine into the different position can also be easily seen in FIG. 2. The receiving cassette 9 in which the individual containers 22 are placed after being labeled can also be easily seen. The shown container is only one possible embodiment. A standing magazine (not shown) would also be possible.

Figure 3:
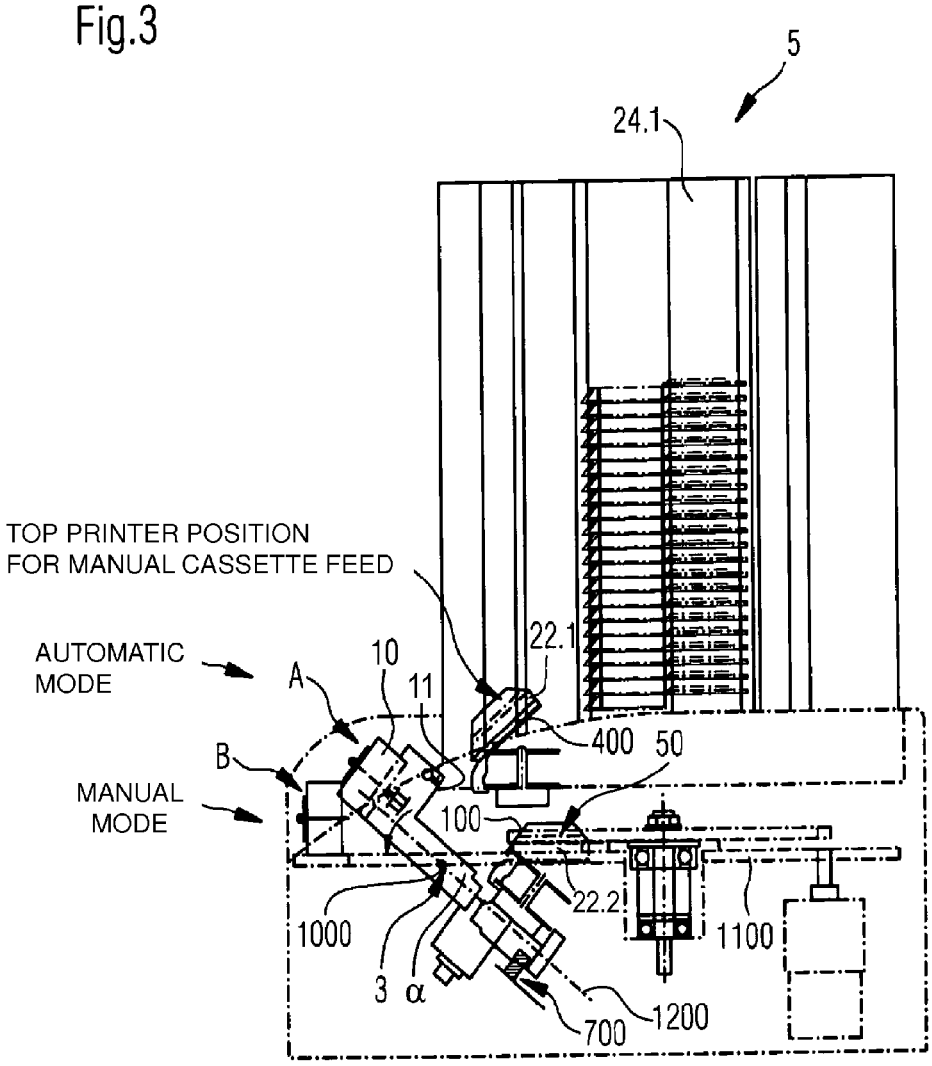
FIG. 3 is a view of the printing device of the apparatus that can be moved into two positions.

FIG. 3 shows the printing device in detail. The printing device 3 has a printhead, especially a needle printhead 10 with printing side 11. In the shown position, the printing device 3 has been moved into the first position A, that is, pivoted about axis 1000 out of plane 1100 in which the transport device comes to rest into plane 1200. Plane 1100 and plane 1200 enclose an angle $\alpha$, that is, the print head in the first position, i.e., in position A for automated supply as shown in FIG. 3, is swung downward out of plane 1100 by angle $\alpha$. In automatic operation, the pushing device 50 automatically supplies to the printing device 3. The cassette that is to be automatically labeled is identified as 22.2. Since the containers 22.2 are beveled on the side 100 to be labeled and since the printing plane lies substantially in the same plane as the surface 100 to be printed, the printing device in position A is swung upward by angle $\alpha$ that substantially corresponds to the angle of the bevel. If the angle of the bevel lies between 40° and 45°, the upswing angle $\alpha$ for the printing device also lies between 40° and 45°. FIG. 3 also shows the cassettes 22 in the magazine 24.1 of the supply device 5. By pivoting on the axis 1000, the printing device 3 can be moved out of the first position A in which the plane 1200 encloses angle $\alpha$ with plane 1100, for example into position B for manual operation. FIG. 3 also shows the guide device 400 for manual supply from above, as well as the cassette 22.1 guided in the guide device that is manually supplied to the printhead in position B. In manual operation, the printing device is pivoted upward about axis 1000, and plane 1200 in which the printing device comes to rest is parallel to plane 1100 in which the transport device is located. A detection device 700 is provided for turning off automatic supply, that is, automatic operation, and enabling manual supply. The detection device 700 can be a magnetic switch. When the printing device is in position A, the switch is closed. If, by pivoting on axis 1000, the printing device is moved out of position A into position B the switch is opened, and the control and regulation device automatically disables automatic supply and automatic operation. Only manual supply is then possible.

The device according to the invention provides an automated labeling device that, for the first time, is distinguished by a high degree of reliability and abrasion-resistant lettering. In particular, the device is designed so that the area in which printing occurs with manual supply is spatially separate from the area in which automated supply occurs. Consequently, when a container is manually supplied, the automatic supply is interrupted as briefly as possible, preferably less than 20 seconds and in particular even less than 5 seconds.

As described above, the apparatus enables automated labeling and very easy manual labeling since automatic operation can be switched very quickly to manual operation by pivoting the printing device, for example by means of a lever that is detected by the control and regulating device. It is also possible to process batches and label individual containers while processing the batch by interrupting batch operation and manually labeling the container.

What is claimed is:

1. A method for labeling a container in a printing device having a needle printer and designed to pivot about an axis into first and second positions, comprising:

when the printing device is in the first position, transporting the container via a transport device from a supply storage that holds the container to a pushing and gripping device;

using the pushing and gripping device, placing the container into a printing position in the printing device;

printing a label for the container using the needle printer;

after printing the label, moving the container via the pushing and gripping device from the printing device to the transport device;

supplying the container to the receiving receptacle via the transport device;

detecting whether or not the printing device is in the first position;

if the printing device is not in the first position, deactivating the transport device; and manually supplying the container to and removing the container from the printing device using a guide device.

2. The method according to claim 1, wherein the label includes a dye that becomes polymerized when exposed to polymerizing light, and further comprising after the label is printed on the container, illuminating the label with polymerizing light to polymerize the dye.

3. The method of claim 1, wherein the container is a medical specimen container.

* * * * *